United States Patent [19]

Roberts et al.

[11] 4,168,671

[45] Sep. 25, 1979

[54] WORK TABLE FOR OPEN-ARM SEWING MACHINES

[75] Inventors: Kent S. Roberts; Brent J. Roberts, both of American Fork, Utah

[73] Assignee: Roberts Manufacturing Company, American Fork, Utah

[21] Appl. No.: 883,396

[22] Filed: Mar. 6, 1978

[51] Int. Cl.[2] ..... A47B 29/00

[52] U.S. Cl. ..... 112/217.1; 108/112; 112/260

[58] Field of Search ..... 112/260, 217.1; 108/98, 108/112; 312/22, 23, 26, 27, 28, 29

[56] References Cited

U.S. PATENT DOCUMENTS

| | | | |
|---|---|---|---|
| Re. 28,835 | 6/1976 | Roberts et al. | 112/217.1 |
| 3,011,846 | 12/1961 | Blevins | 108/112 |
| 3,726,237 | 4/1973 | Devey et al. | 108/92 |

FOREIGN PATENT DOCUMENTS

| | | | |
|---|---|---|---|
| 518729 | 3/1955 | Italy | 112/217.1 |

*Primary Examiner*—Henry Jaudon

*Attorney, Agent, or Firm*—Mallinckrodt & Mallinckrodt

[57] ABSTRACT

A work table of the type having a primary or base table top and a secondary table top mounted by means of parallel motion mechanism on such base table top so as to be lowered from a normal working position relative to an open-arm sewing machine resting on the base table top to an open-arm working position relative to such machine and having a short supporting leg for the secondary table top, which leg is adapted to rest upon the base table top in the normal working position, is improved by making the supporting leg retractable and arranging the parallel motion mechanism so that it does not pass dead center in the raising of the secondary table top to normal working position. In this way, considerable saving in table top material is achieved and raising and lowering thereof is facilitated. It is preferable that the supporting leg be part of a crank mechanism for easily and conveniently raising and lowering the secondary table top through the relatively short swinging stroke of the parallel motion mechanism made possible by the invention.

7 Claims, 8 Drawing Figures

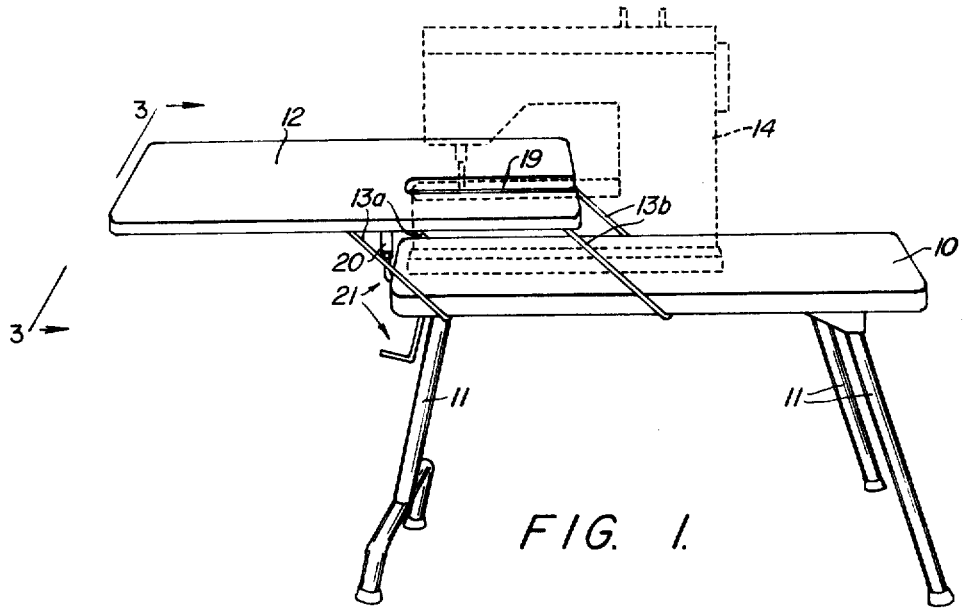
FIG. 1.
FIG. 2.
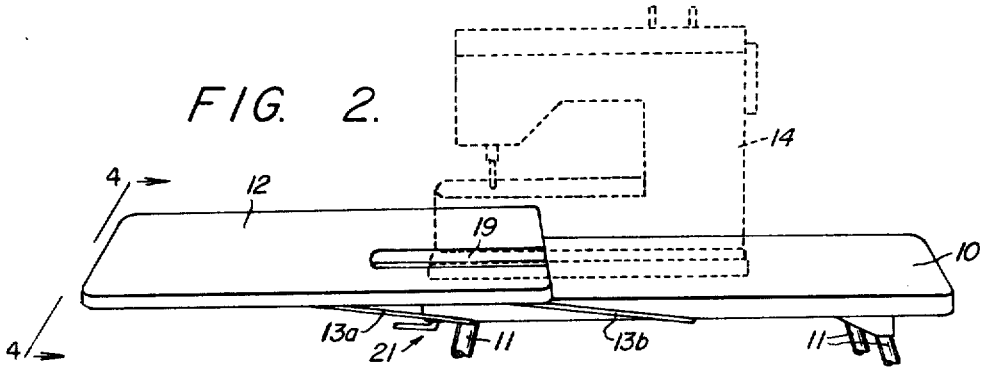
FIG. 3.
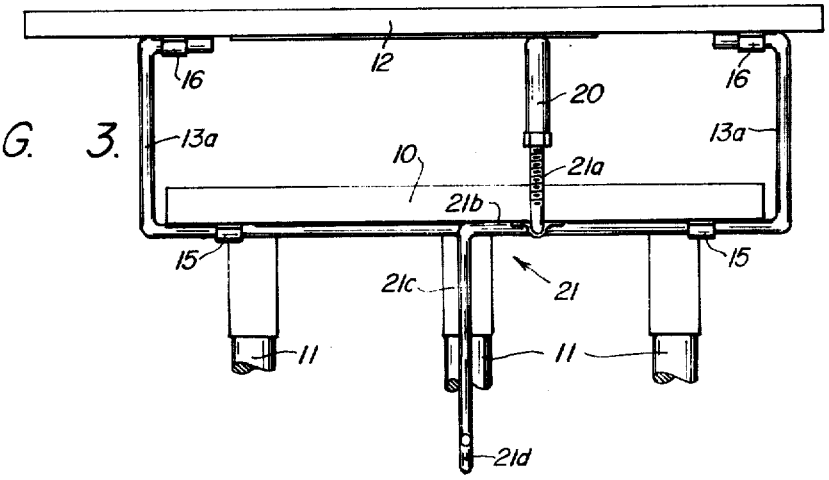
FIG. 4.
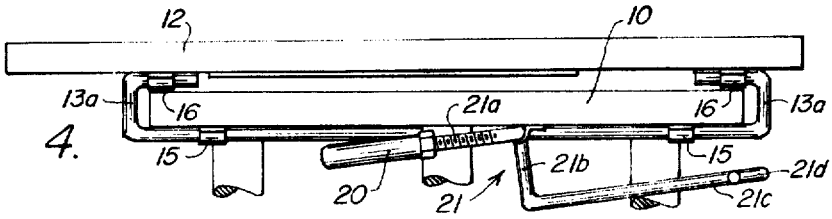

WORK TABLE FOR OPEN-ARM SEWING MACHINES

BACKGROUND OF THE INVENTION

1. Field

The invention is in the field of work tables for sewing machines of open-arm type.

2. State of the Art

Sewing machines of open-arm type present special problems from the standpoint of tables used to support them during work. There are two working positions. Both must be considered in the design of a work table for use with such machines. Various constructions have been developed heretofore to serve the purpose, see U.S. Pat. Nos. 3,011,846 and 3,726,237. It is also known to employ legs depending rigidly from the underside of the secondary table top to support such secondary table top in its normal working position relative to an open-arm type of sewing machine resting on the primary or base table top. However, such supporting legs are positioned relative to the parallel motion mechanism in a manner that necessitates their clearance of such base table top in the lowered, open-arm position of the secondary table top and the passing of such parallel motion mechanism over its dead center position to the opposite side thereof (a long swinging stroke) in moving the secondary table top to its raised, normal working position. Thus, the table tops must be sufficiently long to accommodate this action of the parallel motion mechanism. Moreover, as has been customary in all forms of these tables, raising and lowering of the secondary table top has required the user to manually grasp such secondary table top and swing it over the dead center position of the parallel motion mechanism to bring it to normal working position against the sewing machine.

SUMMARY OF THE INVENTION

In accordance with the invention, a supporting leg (or legs) is retractably mounted on either the primary or the secondary table top at a location which would prevent lowering of the secondary table top if such supporting leg were not retractable, and the arrangement of table tops and parallel motion mechanism is such that the parallel motion mechanism does not swing over dead center in the raising and lowering of the secondary table top from one working position thereof to the other. In this way, the table tops can be effectively shortened, with concomitant saving of a considerable amount of table to material. Moreover, lifting and lowering of the secondary table top encompasses only a short swing of the parallel motion mechanism, never passing over dead center. This facilitates operation of the table.

It is preferred to provide the supporting leg as part of a crank mechanism by which the secondary table top can be raised or lowered by crank manipulation, thereby making change in working position of such secondary table top very easy and convenient.

THE DRAWINGS

Embodiments of sewing machine tables representing the best mode presently contemplated of carrying out the invention in actual practice are illustrated in the accompanying drawings in which:

FIG. 1 is a pictorial view of one type of table incorporating the invention, the secondary table top being illustrated in its raised, normal, work position relative to an open-arm sewing machine shown by dotted lines;

FIG. 2, a similar view in which the table legs have been broken away and in which the secondary table top is illustrated in its lowered, open-arm, work position;

FIG. 3, an end elevational view looking from the left in FIG. 1 (see the line 3—3 of FIG. 1), but drawn to a larger scale with table legs broken away;

FIG. 4, a similar view with respect to FIG. 2;

FIG. 5, a fragmentary view in side elevation looking from the right in FIG. 3 to show details of the crank mechanism;

FIG. 6, a view corresponding to that of FIG. 3, but illustrating a somewhat different embodiment of the invention wherein the retractable supporting leg for the secondary table top is not part of a crank mechanism;

FIG. 7, a view corresponding for the most part with that of FIG. 1 but with minor portions broken away to show otherwise hidden parts and illustrating yet another embodiment that utilizes a crank mechanism and wherein the secondary table top assumes a flush relationship with the base table in its lowered, open-arm, work position; and FIG. 8, an elevational view of the table of FIG. 7 taken from the same standpoint as FIG. 7.

DETAILED DESCRIPTION OF THE ILLUSTRATED EMBODIMENTS

Figure 5:
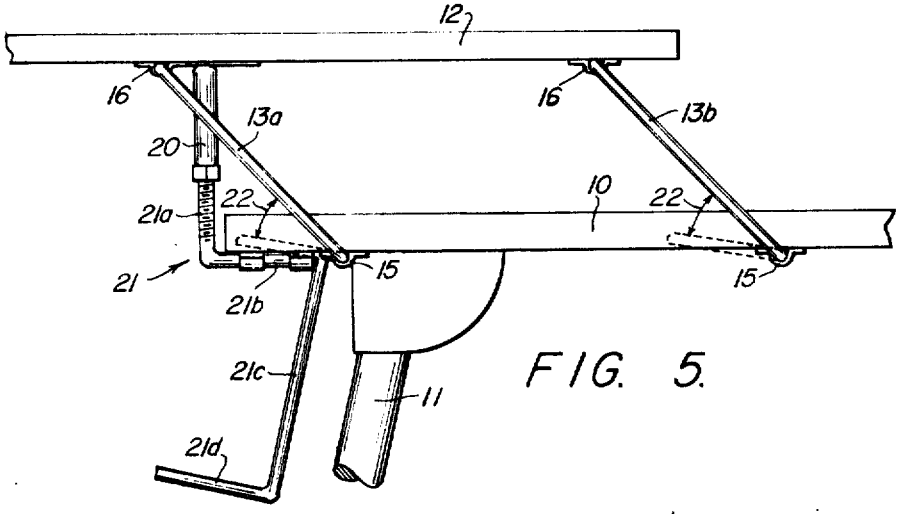

In the form illustrated in FIGS. 1–5, the work table of the invention is similar in many respects to the work table of the aforementioned U.S. Pat. No. 3,726,237, having a primary or base table top 10 supported by the usual table legs 11, which are preferably constructed to fold against the underside of such base table top 10 to provide portability for and to facilitate storage of the work table, and having a secondary table top 12 mounted on base table top 10 by the usual parallel motion mechanism 13 for movement from the raised, normal work position of FIG. 1, relative to an open-arm type of sewing machine 14, to the lowered, open-arm, work position of FIG. 2. As is usual, the forward links **13*a* of the parallel motion mechanism are formed as respectively opposite ends of a unitary linkage bar that is journaled to the underside of base table top 10 by bearing brackets 15, FIG. 3, and is journaled to the underside of secondary table top 12 by bearing brackets 16, while the rearward links 13*b* are similarly formed, their unitary linkage bar being journaled by bearing brackets 17 and 18, FIG. 5**, corresponding to those of the front linkage bar, respectively.

In its lowered, open-arm, work position of FIG. 2, secondary table top 12 rests upon and is supported by the forward end of base table top 10, as illustrated. In its raised, normal working position of FIG. 1, its usual elongate slot 19 closely receives the arm of sewing machine 14 at sewing level, as illustrated.

In the form shown in U.S. Pat. No. 3,726,237, the secondary table top is supported in this raised, normal, working position by the sewing machine itself, which is anchored to base table top in some suitable manner. Other forms of this patented work table have utilized two short, supporting legs extending rigidly from the underside of the secondary table top at respective positions which clear the forward end of the base table top in the lowered, open-arm, work position of the secondary table top but overhang such base table top so that the legs rest thereon in the raised, normal, work position of such secondary table top. As so constructed, it is not necessary to anchor the sewing machine.

Pursuant to the present invention, a short retractable leg 20 in the embodiment of FIG. 1-5 is positioned to support secondary table top 12 in its raised position. In the embodiment of FIG. 6, a short retractable leg 20' is positioned to do the same thing, so far as support is concerned, with respect to secondary table top 12'. In both embodiments, the location of the short retractable leg is such that the secondary table top could not be lowered if the leg were rigidly fixed, instead of being retractable. Moreover, in both embodiments, the arrangement of table tops and parallel motion mechanism is such that the alternative work positions of the secondary table top are reached, in the raising and lowering of such secondary table top, by a very short swinging stroke of the parallel motion mechanism that is short of passing through dead center. This is in contrast to the usual arrangement, in which it is necessary to swing the secondary table top through a relatively long stroke of the parallel motion mechanism from one side of dead center to the opposite side thereof. This means that the table tops may be made considerably shorter than customary, with concomitant savings in structural materials.

Further in accordance with the present invention, it is advantageous and normally preferred to provide the retractable leg as part of crank mechanism for raising and lowering the secondary table top, so that it need not be manually grasped and awkwardly raised and lowered as is customary with prior sewing machine tables of this general type.

Thus, in the embodiment of FIGS. 1-5, short leg 20 is provided at the terminal portion of the work lever arm 21*a* of crank mechanism 21, which mechanism is journaled on the underside of base table top 12 at the forward end thereof and along the length of an intermediate fulcrum portion 21*b* of such crank mechanism. A power lever arm 21*c* has a handle portion 21*d* for use in turning the crank in one direction or the other to raise or lower work arm 20*a* and so lift secondary table top 10 or permit it to drop under the influence of gravity.

Figure 6:
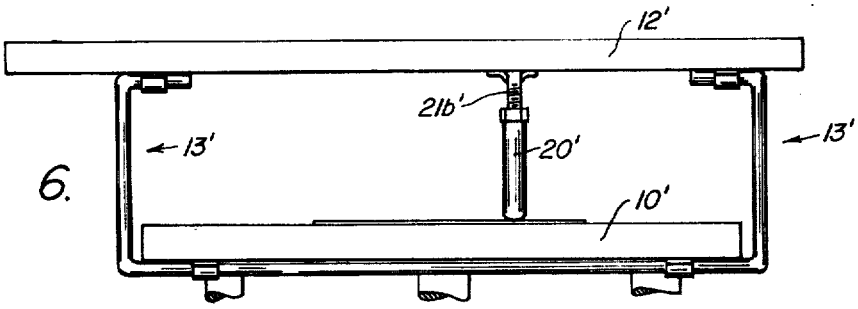

When crank work arm 20*a* is raised so that leg 20 is vertical, the sets of links 13*a* and 13*b* of parallel motion mechanism 13 have moved only through short, acutely angular strokes indicated at 22, FIG. 5.

It is desirable that the exact length of the short leg be adjustable so that the raised, normal work position of the secondary table top can be precisely set to fit the particular sewing machine. Also, it is desirable that the working terminus of such leg be somewhat rounded and of a material that will slide easily on the undersurface of the secondary table top. As shown, short leg 20 is formed as desired, being screwed onto the threaded end of work arm 21*a* of the crank mechanism for adjustment purposes.

In the embodiment of FIG. 6, short leg 20' is similarly journaled, at 21*b'*, but on the underside of secondary table top 10' and without benefit of crank mechanism. It is located to clear the end of base table top 12' in the lowered, open-arm, work position of secondary table top 10' and to be manually grasped and swung down on its pivot axis to rest on base table top 12' when secondary table top 10' is swung upwardly on parallel motion mechanism 13'.

It should be realized that the short leg, whether part of a crank mechanism or otherwise, could be variously arranged as long as it is retractable so as not to interfere with the secondary table top resting firmly on the base table top when it is lowered, open-arm, work position.

Figure 7:
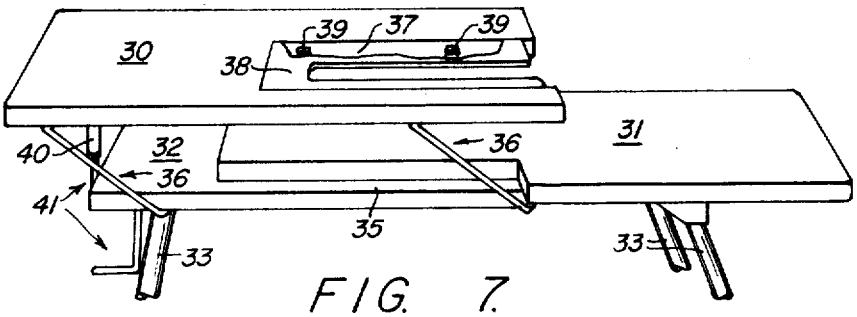
Figure 8:
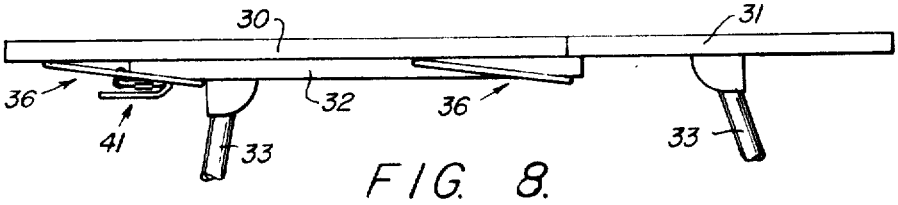

The embodiment of FIGS. 7 and 8 is constructed so that the work surface of secondary table top 30 will be flush with the work surface of primary or base table top 31 when such secondary table top is in the lowered, open-arm, work position of FIG. 8. For this purpose, as is known in the art, base table top 31 is composite, having an underlying panel member 32 at and projecting forwardly from its forward end and secured in face-to-face relationship therewith. Forward table legs 33 are connected directly to such panel member 32, while corresponding rearward table legs 34 are connected directly to the underside of base table top 31.

The forward portion 31*a* of base table top 31, much or all of which overlies panel member 32, is narrower than and intermediately (not necessarily nor even preferably centrally) disposed with respect to such panel member to provide elongate, depressed shoulders 35 extending along respectively opposite sides of such forward portion 31*a* of base table top 31 for receiving and supporting secondary table top 30 so that its work surface will be flush with the work surface of base table top 31 when the secondary table top is lowered into its open-arm, work position by means of parallel motion mechanism 36, as shown in FIG. 8.

The rearward portion of secondary table top 30 is widely indented inwardly from and along its rearward end, as at 37, to receive and snugly accommodate the narrower forward portion 31*a* of base table top 31 when such secondary table top is in its lowered, open-arm, work position. For snugly encompassing the sewing arm of an open-arm sewing machine resting on base table top 31 when secondary table top in its raised, normal, work position, a properly slotted insert panel 38 is mounted in indentation 37 of secondary table top 30 when such table top is raised. Here, as shown in FIG. 7, insert panel 38 rests on and is supported by small brackets 39 secured to the edge faces defining indentation 37 of secondary table top 30 so as to protrude only slightly into such indentation.

In keeping with the present invention, a short supporting leg 40 for secondary table top 30 in its raised position is part of crank mechanism 41, which is attached to base table top 31 by being journaled to the underside of panel member 32 at the forward end thereof. Again, only a short swinging stroke, short of passing over dead center, is required in the raising and lowering of secondary table top 30 from one work position to the other.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In a work table for open-arm sewing machines, which table includes a base table top for receiving an open-arm sewing machine, a secondary table top, and parallel motion mechanism mounting said secondary table top for movement from a raised, normal, work position to a lowered, open-arm, work position, and vice versa, the improvement comprising at least one short supporting leg for positioning between said table tops and for supporting the secondary table top when in its said raised, normal, work position, said leg being attached to one of said tables, being retractable from its supporting position, and being located so as to support the secondary table top in said raised position thereof after the parallel motion mechanism has executed a relatively short swinging stroke without having passed over dead center.

2. An improvement in accordance with claim 1, wherein the short supporting leg is length adjustable.

3. An improvement in accordance with claim 1, wherein the short supporting leg is part of and is raised and lowered by a crank mechanism.

4. An improvement in accordance with claim 1, wherein the crank mechanism is attached to the base table top.

5. An improvement in accordance with either claim 3 or claim 4, wherein the crank mechanism comprises a work lever arm adapted to stand upright when supporting the secondary table top and to lie substantially horizontally when the secondary table is in lowered, open-arm, work position; a substantially horizontal fulcrum portion journaled for back and forth rotative movement; and a power arm adapted to be manipulated by a user of the table.

6. An improvement in accordance with claim 1, wherein the secondary table top overlies the base table top and rests thereon in the lowered, open-arm, work position of such secondary table top.

7. An improvement in accordance with claim 1, wherein the base table top is composite in formation, having a rearward extending panel member disposed intermediate its width and secured to its underface, the forward portion of said base table top being narrower than the underlying panel member to provide supporting shoulders for the secondary table top in its lowered, open-arm, work position, the work surface of the secondary table top being flush with the work surface of the base table top in the said lowered work position; and the secondary table top being indented from its rearward end for snugly receiving said forward position of the base table top in said lowered work position, and wherein there is provided an insert panel for the indentation of the secondary table top, slotted to snugly receive the sewing arm of a sewing machine resting on the base table top, when such secondary table top is in its raised, normal, work position.

* * * * *